US012383049B2

(12) United States Patent
Zhang et al.

(10) Patent No.: US 12,383,049 B2
(45) Date of Patent: Aug. 12, 2025

(54) ORAL CARE IMPLEMENT

(71) Applicant: Colgate-Palmolive Company, New York, NY (US)

(72) Inventors: Bo Zhang, Yangzhou (CN); Guoqiang Liu, HanJiang Area (CN); Yanmei Ji, Suzhou (CN)

(73) Assignee: Colgate-Palmolive Company, New York, NY (US)

( * ) Notice: Subject to any disclaimer, the term of this patent is extended or adjusted under 35 U.S.C. 154(b) by 554 days.

(21) Appl. No.: 17/770,202

(22) PCT Filed: Nov. 4, 2019

(86) PCT No.: PCT/CN2019/115264
§ 371 (c)(1),
(2) Date: Apr. 19, 2022

(87) PCT Pub. No.: WO2021/087647
PCT Pub. Date: May 14, 2021

(65) Prior Publication Data

US 2022/0395082 A1 Dec. 15, 2022

(51) Int. Cl.
*A46B 9/04* (2006.01)
*A46B 3/16* (2006.01)
*A46B 15/00* (2006.01)

(52) U.S. Cl.
CPC ..... *A46B 3/16* (2013.01); *A46B 9/04* (2013.01); *A46B 15/00* (2013.01); *A46B 2200/1066* (2013.01)

(58) Field of Classification Search
CPC ..... A46B 3/16; A46B 9/04; A46B 15/00
See application file for complete search history.

(56) References Cited

U.S. PATENT DOCUMENTS 1,448,744 A 3/1923 Hastings
1,879,103 A 9/1932 Connor
(Continued)

FOREIGN PATENT DOCUMENTS

CN 1203516 12/1998
CN 2754439 2/2006
(Continued)

OTHER PUBLICATIONS

Ge, Jiajia (Officer), Chinese Intellectual Property Office, International Search Report and Written Opinion issued in PCT Application No. PCT/CN2020/096485, issued Mar. 16, 2021, pp. 1-11.
(Continued)

*Primary Examiner* — Michael D Jennings

(57) ABSTRACT

An oral care implement (100) including a head portion (120) that extends from a proximal end (121) to a distal edge (122) along a longitudinal axis (A-A). The head portion (120) may be formed of a cellulosic material such as a wood material or a bamboo material having a longitudinal grain direction. The head portion (120) may include a plurality of tuft holes (130) such that a bristle tuft (151) is anchored to the head portion (120) within each of the tuft holes (130) by an anchor (200). The anchors (200) may extend along an anchor axis that is oblique to the longitudinal axis (A-A). The bristle tufts (151) may include perimeter bristle tufts (153,154) located within perimeter tuft holes (140) that are adjacent to a perimeter (128) or peripheral edge (126,127) of the head portion (120). The perimeter tuft holes (140) may be located at least 1.80 mm from the perimeter (128) of the head portion (120).

20 Claims, 5 Drawing Sheets

(56) References Cited

U.S. PATENT DOCUMENTS

| | | | | |
|---|---|---|---|---|
| 2,409,490 | A | 10/1946 | Jobst | |
| 3,430,281 | A | 3/1969 | Baumgartner | |
| 5,724,697 | A | 3/1998 | Klee et al. | |
| 5,740,579 | A | 4/1998 | Fassler | |
| 6,009,589 | A * | 1/2000 | Driesen | A46B 3/16 15/205 |
| 6,269,514 | B1 * | 8/2001 | Edwards | A46B 5/06 15/205 |
| 8,402,591 | B2 | 3/2013 | Paciullo | |
| 9,119,462 | B2 | 9/2015 | Gliemroth et al. | |
| 11,406,172 | B2 * | 8/2022 | Scheurich | B29C 45/14065 |
| 2003/0074755 | A1 * | 4/2003 | Ale | A46B 7/04 15/201 |
| 2008/0104785 | A1 * | 5/2008 | Robinson | A46B 3/16 15/207.2 |
| 2011/0000040 | A1 * | 1/2011 | Paciullo | A46B 3/16 411/457 |
| 2013/0139339 | A1 * | 6/2013 | Hess | A46D 3/00 15/167.1 |
| 2017/0347785 | A1 * | 12/2017 | Huang | A46B 9/04 |
| 2018/0055207 | A1 * | 3/2018 | Hohlbein | A46B 9/028 |
| 2018/0125218 | A1 * | 5/2018 | Dengler | A46B 3/10 |
| 2018/0132988 | A1 * | 5/2018 | Dengler | A46B 3/20 |
| 2019/0015183 | A1 * | 1/2019 | Liu | A61C 17/3436 |
| 2019/0133311 | A1 * | 5/2019 | Boucherie | B29C 66/8223 |
| 2019/0350354 | A1 * | 11/2019 | Watcharotone | A46D 1/0276 |
| 2021/0315375 | A1 | 10/2021 | Dingizian | |
| 2022/0386767 | A1 | 12/2022 | Waldemar | |

FOREIGN PATENT DOCUMENTS

| | | | |
|---|---|---|---|
| CN | 1874705 | | 12/2006 |
| CN | 2933129 | | 8/2007 |
| CN | 101010018 | | 8/2007 |
| CN | 101568276 | | 10/2009 |
| CN | 201920026 | | 8/2011 |
| CN | 102469871 | | 5/2012 |
| CN | 102821648 | | 12/2012 |
| CN | 103799684 | | 5/2014 |
| CN | 205625065 | | 10/2016 |
| CN | 106413472 | | 2/2017 |
| CN | 206896059 | | 1/2018 |
| CN | 207979242 | | 10/2018 |
| CN | 208639788 | | 3/2019 |
| CN | 110113963 | | 8/2019 |
| CN | 209489659 | | 10/2019 |
| CN | 111248611 | | 6/2020 |
| DE | 69621338 | | 11/2002 |
| DE | 10163729 | | 7/2003 |
| EP | 0756837 | | 2/1997 |
| EP | 1088495 | | 4/2001 |
| JP | H10-257922 | A | 9/1998 |
| JP | 2001309818 | | 11/2001 |
| JP | 2001309818 | A * | 11/2001 |
| JP | 2004-081286 | | 3/2004 |
| JP | 2009-125084 | A | 6/2009 |
| JP | 2016-010510 | | 1/2016 |
| JP | 2018-108129 | | 7/2018 |
| KR | 20140094332 | | 7/2014 |
| KR | 102019665 | | 11/2019 |
| WO | 1997/046136 | | 12/1997 |
| WO | WO-9917915 | A1 * | 4/1999 ..... A46B 5/02 |
| WO | 2006/115963 | | 11/2006 |
| WO | 2008/081697 | | 7/2008 |
| WO | 2011/002460 | | 1/2011 |
| WO | 2015/177575 | | 11/2015 |
| WO | 2018/135150 | | 7/2018 |
| WO | 2019/238906 | | 12/2019 |
| WO | 2021/078948 | | 4/2021 |
| WO | 2021/087647 | | 5/2021 |
| WO | 2021/253261 | | 12/2021 |

OTHER PUBLICATIONS

Humble Brush—Bamboo Handle Soft Bristles (Bpa-free) Toothbrush. Donating One for Every Sold (Adult, White) retrieved Jun. 19, 2020 from https://www.amazon.com/Humble-Brush-Bristles-Bpa-free-Toothbrush/dp/B011BGLGL8, pp. 1-7.

* cited by examiner

ORAL CARE IMPLEMENT

BACKGROUND

As the deleterious effects of plastic on the environment become more of a concern, consumers are looking to purchase products that use less plastic. One industry that has products made predominately out of plastic is the toothbrush industry. One reason for this is that significant research and development has taken place to improve tuft retention in such plastic toothbrushes so that the bristles are not detaching from the toothbrush body during use. When looking to use a different base material for the toothbrush, bristle retention must be considered once again. Thus, a need exists for a non-plastic based toothbrush having an improved tuft retention.

BRIEF SUMMARY

The present invention is directed to an oral care implement including a head portion that extends from a proximal end to a distal edge along a longitudinal axis. The head portion may be formed of a cellulosic material such as a wood material or a bamboo materials having a longitudinal grain direction. The head portion may include a plurality of tuft holes such that a bristle tuft is anchored to the head within each of the tuft holes by an anchor. The anchors may extend along an anchor axis that is oblique to the longitudinal axis. The bristle tufts may include perimeter bristle tufts located within perimeter tuft holes that are adjacent to a perimeter or peripheral edge of the head. The perimeter tuft holes may be located at least 1.80 mm from the perimeter of the head.

In one aspect, the invention may be an oral care implement comprising: a head portion extending along a longitudinal axis from a proximal end to a distal edge, the head portion formed of a cellulosic material having a longitudinal grain direction; the head portion comprising a plurality of tuft holes; and a plurality of bristles tufts anchored to the head portion within the plurality of tuft holes by a plurality of anchors, each of the anchors extending along an anchor axis that is oblique to the longitudinal axis.

In another aspect, the invention may be an oral care implement comprising: a head portion extending along a longitudinal axis from a proximal end to a distal edge, the head portion formed of a cellulosic material; the head portion comprising a plurality of tuft holes; and a plurality of bristles tufts anchored to the head portion within the plurality of tuft holes by a plurality of anchors; the plurality of tuft holes comprising a plurality of perimeter tuft holes arranged in a loop that is adjacent a perimeter of the head portion, the plurality of bristle tufts comprising a plurality of perimeter bristle tufts disposed within and extending from the perimeter tuft holes; and wherein a distance between the perimeter and any one of the perimeter tuft holes is greater than 1.80 mm.

In yet another aspect, the invention may be an oral care implement comprising: a head portion extending along a longitudinal axis from a proximal end to a distal edge, the head portion formed of a cellulosic material; the head portion comprising a plurality of tuft holes; and a plurality of bristles tufts anchored to the head portion within the plurality of tuft holes by a plurality of anchors; the plurality of tuft holes comprising a plurality of perimeter tuft holes arranged in a loop that is adjacent a perimeter of the head portion, the plurality of bristle tufts comprising a plurality of perimeter bristle tufts disposed within and extending from the perimeter tuft holes; and wherein the plurality of perimeter bristle tufts comprises a distal-most bristle tuft located adjacent the distal edge of the head, and wherein the distal-most bristle tuft is located closer to the perimeter of the head than any of the other perimeter bristle tufts.

In a further aspect, the invention may be an oral care implement comprising: a head portion formed of bamboo and extending along a longitudinal axis, the head portion comprising a plurality of tuft holes; a plurality of bristle tufts anchored to the head portion within the plurality of tuft holes by a plurality of anchors; and wherein the plurality of tuft holes are arranged in a plurality of longitudinal rows that are staggered relative to one another so that no tuft hole in any of the plurality of longitudinal rows is aligned with a tuft hole in an adjacent one of the plurality of longitudinal rows in a direction transverse to the longitudinal axis.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
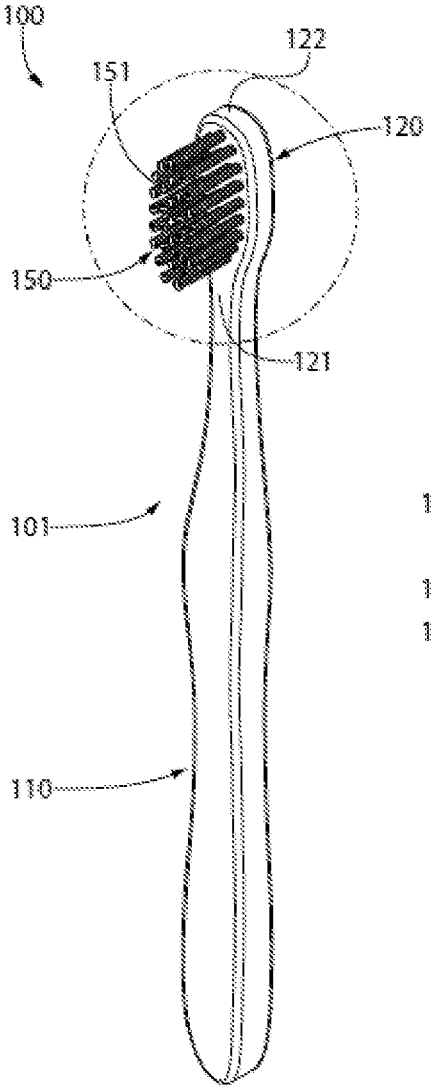
FIG. 1 is a perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIG. 1, an oral care implement 100 is illustrated in accordance with an embodiment of the present invention. The oral care implement 100 comprises a body 101 having a handle portion 110 and a head portion 120. The body 101 is a single, unitary construction such that the handle portion 110 and the head portion 120 are part of the same monolithic component. The body 101 may be formed from a cellulosic material. More specifically, the body 101 may be formed from wood. Still more specifically, in some embodiments the body 101 may be formed from bamboo. As used herein, the term cellulosic may comprise wood materials and parts thereof and bamboo materials and parts thereof.

The handle portion 110 is the portion of the body 101 that is gripped by a user during use thereof. Thus, the handle portion 110 preferably has a length and width that is selected for user comfort so that a user can clasp his/her hand around the handle portion 110 to use the oral care implement 100 for oral cavity treatment such as toothbrushing. The handle portion 110 is elongated and may have various contours to enhance user comfort. In the exemplified embodiment, the side surfaces of the handle portion 110 appear to be wavy which may allow the handle portion 110 to sit more comfortably within a user's palm. The handle portion 110 may have flat front and rear surfaces and/or may include bumps, ridges, or protrusions to enhance grip. The handle portion 110 may be partially or fully encased or covered with a gripping material, such as a thermoplastic elastomer, to further increase usability. Thus, various modifications to the handle are possible within the scope of the invention described herein and the invention is not intended to be limited by the structure or shape of the handle portion 110 shown in the drawings. In some embodiments, the cellulosic material (e.g., wood, bamboo) that forms the body 101 may be coated with a beeswax to prevent any possibilities of mold growth thereon.

Figure 2:
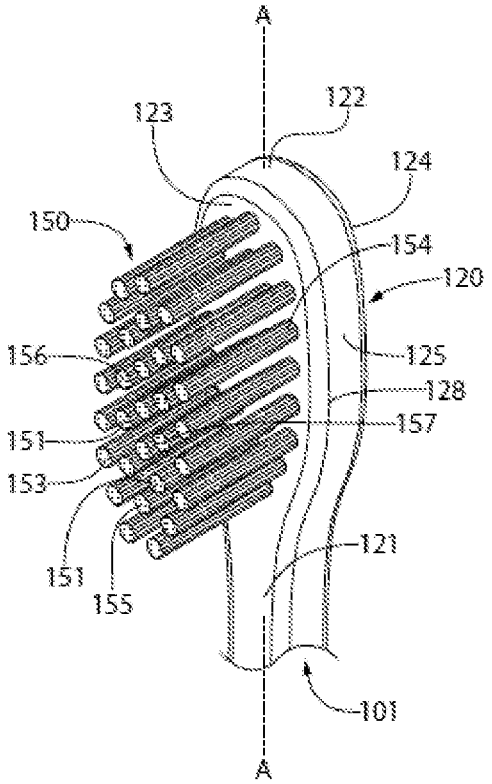
FIG. 2 is a close-up view of area II of FIG. 1 illustrating a head portion of the oral care implement.
Figure 3:
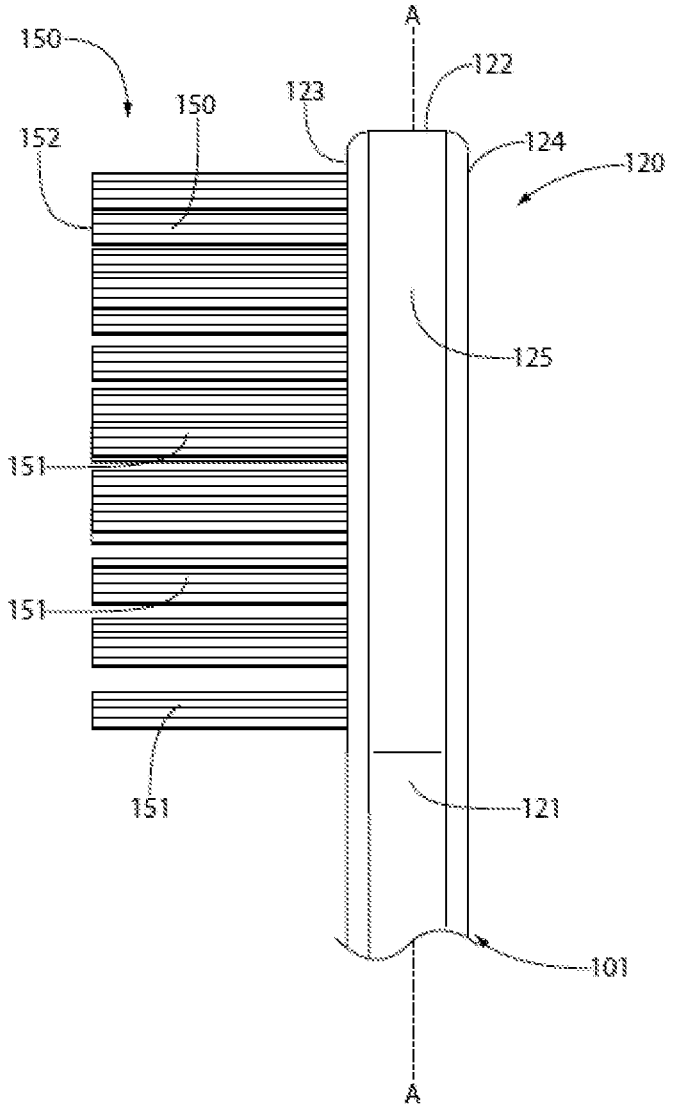
FIG. 3 is a side view of the head portion of the oral care implement of FIG. 1.

Referring to FIGS. 1-3, the head portion 120 will be described. The head portion 120 extends from a proximal end 121 where it is connected to the handle portion 110 to a distal edge 122 that forms a distal end of the body 101. The head portion 120 extends along a longitudinal axis A-A from the proximal end 121 to the distal edge 122. The head portion 120 comprises a front surface 123, a rear surface 124 opposite the first surface 123, and a peripheral surface 125 extending between the front and rear surfaces 123, 124. The region where the peripheral surface 125 intersects the front surface 123 may be referred to herein as a perimeter 128 of the head portion 120.

A plurality of bristle tufts 151 are anchored to the head portion 120 of the body 101 so that the bristle tufts 151 extend outwardly from the front surface 123 of the head portion 120. Only a few of the bristle tufts 151 are labeled in the figures in order to prevent clutter. As will be discussed in detail below with reference to FIG. 4, each of the plurality of bristle tufts 151 is located within a tuft hole in the head portion 120 and then secured thereto by an anchor. The bristle tufts 151 collectively define a bristle field 150. Each of the bristle tufts 151 comprises a plurality of bristles that are clumped together into the tuft and inserted into a singular tuft hole formed into the head portion 120. The bristles within each of the bristle tufts 151 may be, for example without limitation, filament bristles, fiber bristles, nylon bristles, polybutylene terephthalate (PBT) bristles, spiral bristles, core-sheath bristles, tapered bristles, end-rounded bristles, or the like. Combinations of these different bristle types may be positioned in the same bristle tuft 151 or each bristle tuft 151 may contain only one bristle type. The bristles may have varying diameters including 7 mm, 8 mm, and 9 mm. Some of the bristles and/or bristle tufts 151 may be infused with charcoal, bamboo salt, or other natural ingredients as may be desired.

In the exemplified embodiment, the bristle tufts 151 are the only tooth cleaning elements coupled to and extending from the head portion 120. Of course, the invention is not to be so limited in all embodiments and in some alternative embodiments there may also be lamella or rubber cleaning elements including rubber bristles, elastomeric protrusions, flexible polymer protrusions, or the like extending from the head. Thus, cleaning elements for cleaning, polishing, or wiping the teeth and/or soft oral tissue may be formed from other materials.

As best seen in FIG. 3, in the exemplified embodiment the bristle field 150 formed by the plurality of bristle tufts 151 has a flat trim profile. Specifically, each of the bristle tufts 151 has the same height measured from the front surface 123 of the head portion 120 to a distal end 152 of the bristle tuft 151. As a result, the distal ends 152 of the bristle tufts 151 collectively lie on a common plane that is parallel to the front surface 123 of the head portion 120. However, the invention is not to be so limited in all embodiments and in some other embodiments the bristle tufts 151 may have varying heights to create a wavy or other trim profile that is not flat and planar as shown in the exemplified embodiment.

As mentioned above, the body 101 of the oral care implement 100 may be formed of a wood material. In such embodiments, the wood material may have a longitudinal grain direction. Thus, the grain direction of the wood material of the body 101, and particularly the head portion 120 thereof, is substantially parallel to the longitudinal axis A-A. Stated another way, the wood material of the body 101 has a straight grain, which runs parallel to the longitudinal axis A-A thereof. Of course, as used herein parallel does not mean perfectly parallel and longitudinal grain direction does not mean perfectly longitudinal. The grain direction may be at a slight angle relative to the longitudinal axis A-A, but so long as the grain direction is generally in the longitudinal direction (i.e., the direction of the longitudinal axis A-A) it will be understood to have a longitudinal grain direction.

Figure 4:
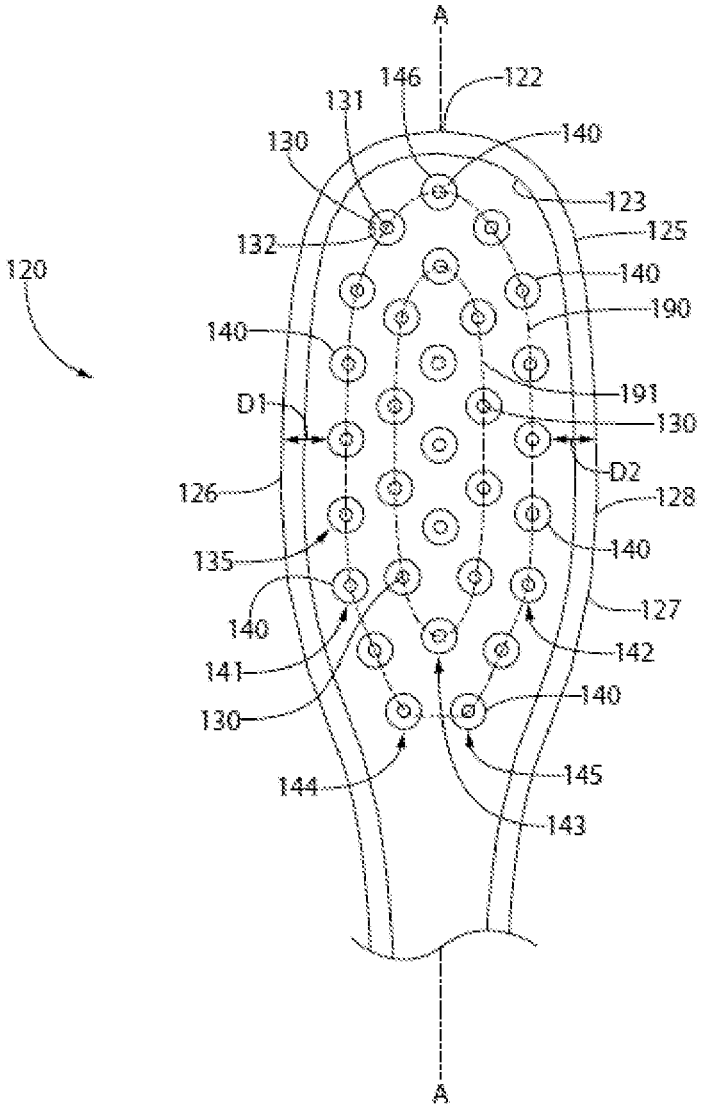
FIG. 4 is a front view of the head portion of the oral care implement of FIG. 1 with bristle tufts omitted so that tuft holes are visible.

Referring now to FIG. 4, the head portion 120 of the oral care implement 100 is illustrated with the bristle tufts 151 removed. The head portion 120 comprises a plurality of tuft holes 130 formed into the front surface 123 thereof. Only a few of the tuft holes 130 are labeled in FIG. 4 in an effort to avoid clutter. Each of the tuft holes 130 is a hole formed into the front surface 123 of the head portion 120 having a height that is less than a thickness of the head portion 120 measured between the front and rear surfaces 123, 124 of the head portion 120. Thus, the tuft holes 130 are each defined by a floor 131 that is recessed relative to the front surface 123 of the head portion 120 and a sidewall 132 that extends from the floor 131 to the front surface 123 of the head portion 120. The tuft holes 130 have round cross-sectional areas in the exemplified embodiment, but they could take on other shapes in other embodiments. The tuft holes 130 may have a diameter of between 1.4 and 1.8 mm, more specifically between 1.5 and 1.7 mm, and still more specifically approximately 1.6 mm.

In the exemplified embodiment, the tuft holes 130 are arranged in longitudinal rows that are staggered relative to one another. Thus, no tuft hole 130 in any of the plurality of longitudinal rows is aligned with a tuft hole 130 in an adjacent one of the plurality of longitudinal rows. Although there may be some overlap between tuft holes in adjacent longitudinal rows, the centerpoints of the tuft holes 130 in adjacent longitudinal rows are not aligned (i.e., a plane that is transverse to the longitudinal axis A-A will not intersect the centerpoints of any two tuft holes 130 in two adjacent longitudinal rows). The tuft holes 130 collectively define a tuft hole field 135. A spacing between the plurality of tuft holes 130, which is measured as a linear distance from one of the plurality of tufts holes 130 to an adjacent one of the plurality of tuft holes 130, varies throughout the tuft hole field 135. Thus, there is not an equal spacing amongst all of the tuft holes 130. This may be true both within one of the longitudinal rows and between adjacent longitudinal rows in some embodiments. In some embodiments, the tuft holes 130 of the tuft hole field 135 are symmetric about the longitudinal axis A-A of the head portion 120.

The peripheral surface 125 of the head portion 120 comprises a first side edge 126 and a second side edge 127. The first and second side edges 126, 127 are portions of the peripheral surface 125 that are located on opposite sides of the longitudinal axis A-A. The plurality of tuft holes 130 comprises a first longitudinal row of outermost tuft holes 141 located adjacent to the first side edge 126 and a second longitudinal row of outermost tuft holes 142 located adjacent to the second side edge 127. The plurality of tuft holes 130 also comprises a central longitudinal row of tuft holes 143 located along the longitudinal axis A-A, a first longitudinal row of inner tuft holes 144 located between the central longitudinal row of tuft holes 143 and the first longitudinal row of outermost tuft holes 141, and a second longitudinal row of inner tuft holes 145 located between the central longitudinal row of tuft holes 143 and the second longitudinal row of outermost tuft holes 142.

In the exemplified embodiment, the central longitudinal row of tuft holes 143 is generally aligned on the longitudinal axis A-A. However, in the exemplified embodiment the first and second longitudinal rows of outermost tuft holes 141, 142 and the first and second longitudinal rows of inner tuft holes 144, 145 have some curvature to them such that they are not perfectly straight. Specifically, the first and second longitudinal rows of outermost tuft holes 141, 142 and the first and second longitudinal rows of inner tuft holes 144, 145 are curved so that they have concave sides that face the central longitudinal row of tuft holes 143. Of course, various modifications to the nature of the curvature of each of the various longitudinal rows may be permissible in some alternative embodiments.

In some embodiments, a distance between any two adjacent ones of the tuft holes 130 of the central longitudinal row 143 is greater than 1.5 mm. In another embodiment, the distance between any two adjacent ones of the tuft holes 130 of the central longitudinal row 143 is greater than 1.75 mm. In another embodiment, the spacing between any two adjacent ones of the tuft holes 130 of the central longitudinal row 143 excluding the distal-most tuft hole 146 is at least 2.1 mm.

In addition to being arranged in longitudinal rows, the plurality of tuft holes 130 comprises a plurality of perimeter tuft holes 140 that are arranged in a perimeter loop 190 that is adjacent to the perimeter 128 of the head portion 120. Stated another way, the perimeter tuft holes 140 are those tuft holes 130 that are located closest to the perimeter 128 and the peripheral surface 125 of the head portion 120. Only a few of the perimeter tuft holes 140 are labeled in FIG. 4, but it should be easily understood which of the tuft holes 130 are the perimeter tuft holes 140 (i.e., the tuft holes 130 that are intersected by the perimeter loop 190 that is drawn schematically on FIG. 4).

The tuft holes 130 also form an inner loop 191 that is surrounded by the perimeter loop 190. The tuft holes 130 of the first and second longitudinal rows of inner tuft holes 144, 145 as well as two of the tuft holes 130 of the central longitudinal row of tuft holes 143 collectively from the inner loop 191. In the exemplified embodiment, the inner loop 191 surrounds a plurality, and specifically the three remaining ones of the tuft holes 130 of the central longitudinal row of tuft holes 143.

In the exemplified embodiment, at least one of the perimeter tuft holes 140 is also in the first longitudinal row of outermost tuft holes 141, at least one of the perimeter tuft holes 140 is also in the second longitudinal row of outermost tuft holes 142, at least one of the perimeter tuft holes 140 is also in the first longitudinal row of inner tuft holes 144, at least one of the perimeter tuft holes 140 is also in the second longitudinal row of inner most tuft holes 145, and at least one of the perimeter tuft holes 140 is also in the central longitudinal row of tuft holes 143. Thus, the perimeter tuft holes 140 are not mutually exclusive from the various longitudinal rows of tuft holes, but rather many if not all of the perimeter tuft holes 140 are also located in one of the longitudinal rows 141-145 noted herein.

In the exemplified embodiment, the plurality of perimeter tuft holes 140 comprises a distal-most tuft hole 146, which is the tuft hole 130 that is located closest to the distal edge 122 of the head portion 120. In the exemplified embodiment, the distal-most tuft hole 146 is located in the central longitudinal row of tuft holes 143. Specifically, in the exemplified embodiment the distal-most tuft hole 146 is the only tuft hole that is both a perimeter tuft hole 140 and located in the central longitudinal row of tuft holes 143. Thus, in the exemplified embodiment the distal-most tuft hole 146 is located on (or is aligned with) the longitudinal axis A-A.

Referring briefly to FIG. 2, there are bristle tufts 151 located in each of the tuft holes 130. Specifically, each of the bristle tufts 151 is anchored to the head within one of the plurality of tuft holes 130 by an anchor, such as a staple or the like, which will be described in greater detail below with reference to FIGS. 5-7. More specifically, the plurality of bristle tufts 151 comprises a first longitudinal row of outermost bristle tufts 153 disposed within and extending from the first longitudinal row of outermost tuft holes 141, a second longitudinal row of outermost bristle tufts 154 disposed within and extending from the second longitudinal row of outermost tuft holes 142, a central longitudinal row of bristle tufts 155 disposed within and extending from the central longitudinal row of tuft holes 143, a first longitudinal row of innermost bristle tufts 156 disposed within and extending from the first longitudinal row of inner tuft holes 144, and a second longitudinal row of innermost bristle tufts 157 disposed within and extending from the second longitudinal row of innermost tuft holes 145. Only one bristle tuft 151 within each of the various longitudinal rows is labeled to avoid clutter.

Referring again to FIG. 4, as mentioned above the first longitudinal row of outermost tuft holes 141 are located adjacent to the first side edge 126 of the peripheral surface 125 of the head portion 120. In the exemplified embodiment, a distance D1 between the first side edge 126 and any one of the outermost tuft holes 130 of the first longitudinal row of outermost tuft holes 141 is greater than 1.8 mm. In some embodiments, the distance D1 may be greater than 1.9 mm. In some embodiments, the distance D1 may be greater than 1.95 mm. In some embodiments, the distance D1 is greater than 2.0 mm for all but one of the tuft holes 130 of the first longitudinal row of outermost tuft holes 141. Thus, in some embodiments only one of the tuft holes 130 of the first longitudinal row of outermost tuft holes 141 is located less than 2.0 mm from the first side edge 126 of the head portion 120. In other embodiments, all of the tuft holes 130 of the first longitudinal row of outermost tuft holes 141 may be located at least 2.0 mm from the first side edge 126 of the head portion 120.

As also mentioned above, the second longitudinal row of outermost tuft holes 142 are located adjacent to the second side edge 127 of the peripheral surface 125. In the exemplified embodiment, a distance D2 between the second side edge 127 and any one of the outermost tuft holes 130 of the second longitudinal row of outermost tuft holes 142 is greater than 1.8 mm. In some embodiments, the distance D2 may be greater than 1.9 mm. In some embodiments, the distance D2 may be greater than 1.95 mm. In some embodiments, the distance D2 is greater than 2.0 mm for all but one of the tuft holes 130 of the second longitudinal row of outermost tuft holes 142. Thus, in some embodiments only one of the tuft holes 130 of the second longitudinal row of outermost tuft holes 142 is located less than 2.0 mm from the second side edge 127 of the head portion 120. In other embodiments, all of the tuft holes 130 of the second longitudinal row of outermost tuft holes 142 may be located at least 2.0 mm from the second side edge 127 of the head portion 120.

In some embodiments, the distance D1 between the first side edge 126 and any one of the tuft holes 130 of the first longitudinal row of outermost tuft holes 141 may be measured along a first reference line that is radial to a center of the tuft hole 130 and perpendicular to a tangent line of the first side edge 126. The distance D1 is measured from the first side edge 126 to a part of the relevant tuft hole that is closest to the first side edge 126. Similarly, wherein the distance D2 between the second side edge 127 and any one of the outermost tuft holes 130 of the second longitudinal row of outermost tuft holes 142 may be measured along a reference line that is radial to a center of the tuft hole 130 and perpendicular to a tangent line of the second side edge 127. The distance D2 is measured from the second side edge 127 to a part of the relevant tuft hole that is closest to the second side edge 127.

In some embodiments, a distance between the perimeter 128 and any one of the perimeter tuft holes 140 may be greater than 1.80 mm. In some embodiments, the distance between the perimeter 128 and any one of the perimeter tuft holes 140 may be greater than 1.90 mm. In some embodiments, the distance between the perimeter 128 and any one of the perimeter tuft holes 1.40 may be greater than 1.95 mm. In some embodiments, the distance between the perimeter 128 and each of the perimeter tuft holes 140 with the exception of the distal-most tuft hole 146 may be greater than 2.0 mm. Maintaining this type of spacing between the perimeter 128 of the head portion 120 and the tuft holes that are positioned closest to the perimeter 128 of the head portion 120 (i.e., the perimeter tuft holes 140) increases tuft retention.

In some embodiments, at least 80% of the tuft holes 130 of the perimeter tuft holes 140 are spaced a distance of at least 2.0 mm from the perimeter 128 of the head portion 120. Furthermore, in some embodiments at least 20% of the tuft holes 130 of the perimeter tuft holes 140 are spaced a distance of at least 2.5 mm from the perimeter 128 of the head portion 120. In some embodiments, the proximal-most tuft holes of the perimeter tuft holes 140 (those located closest to the handle portion 110) are located further from the perimeter 128 of the head portion 120 than any of the other tuft holes of the perimeter tuft holes 140 while the distal-most tuft hole 146 is located closer to the perimeter 128 of the head portion 120 than any of the other tuft holes of the perimeter tuft holes 140.

Figure 5:
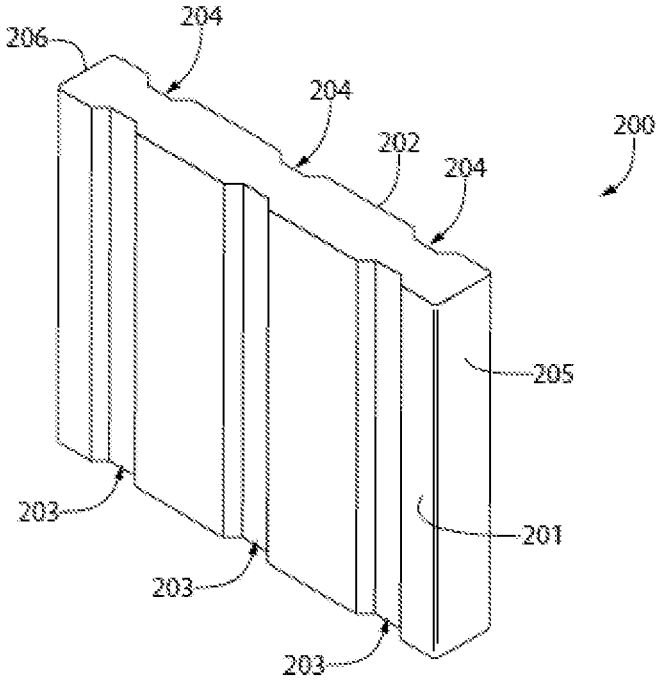
FIG. 5 is a perspective view of an anchor used for anchoring the bristle tufts to the head portion of the oral care implement of FIG. 1 in accordance with an embodiment of the present invention.
Figure 6:
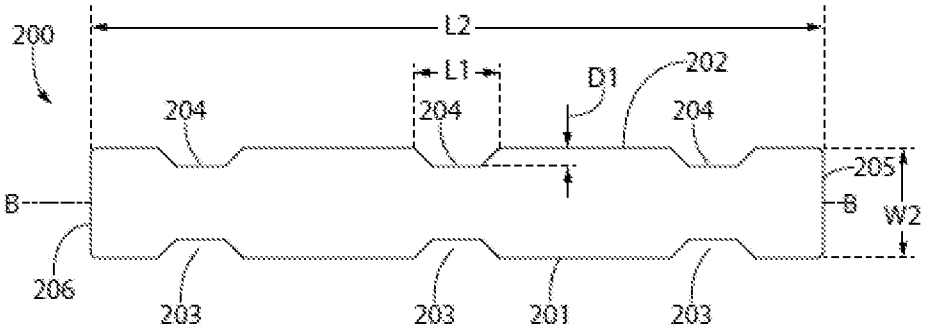
FIG. 6 is a top view of the anchor of FIG. 5.

Referring to FIGS. 5 and 6, an anchor 200 that may be used to secure the bristle tufts 151 within the tuft holes 130 of the oral care implement 100 will be described. The use of the anchors 200 for securing the bristle tufts 151 to the head portion 120 of the oral care implement 100 is commonly referred to as a staple technique. The anchor 200 may be formed out of a metal material in some embodiments, although this is not required in all embodiments. Basically, the bristle tufts 151 are bent into a U shape and then placed into the tuft holes 130 and the anchors 200 are then placed into the tuft holes 130 and secured to the head portion 120 to retain the bristle tufts 151 within the tuft holes 130. The ability of the anchors 200 to remain in place assists with bristle retention by preventing bristles from being detached from the head portion 120 during normal use of the oral care implement 100.

In the exemplified embodiment, the anchor 200 is a double sided grooved anchor. Specifically, the anchor 200 has a first major surface 201 and a second major surface 202 opposite the first major surface 201. There are a plurality of first grooves 203 formed into the first major surface 201 and a plurality of second grooves 204 formed into the second major surface 202. In the exemplified embodiment, each of the first grooves 203 in the first major surface 201 is aligned with one of the second grooves 204 in the second major surface 202. However, this is not required in all embodiments and the first and second grooves 203, 204 may not be aligned in other embodiments. In the exemplified embodiment, there are three grooves on each of the first and second major surfaces 201, 202, although more or less grooves could be used in other embodiments and the spacing therebetween adjusted accordingly. However, the anchor 200 as shown herein with three of the first grooves 203 and three of the second grooves 204 has been found to have an enhanced bristle retention capability.

In the exemplified embodiment, each of the first and second grooves 203, 204 has a trapezoidal shape. However, the invention is not to be so limited in all embodiments. Thus, in some alternative embodiments the first and/or second grooves 203, 204 could have a square, rectangular, rounded, arcuate, or the like shape. Thus, the invention is not to be particularly limited by the shape or alignment of the first and second grooves 203, 204 in all embodiments.

In the exemplified embodiment, each of the first and second grooves 203, 204 has a length L1 of between 0.2 and 0.3 mm, more specifically between 0.2 and 0.25 mm, and still more specifically approximately 0.23 mm. The first and second grooves 203, 204 may also have a depth D1 of between 0.03 and 0.1 mm, more specifically 0.04 and 0.06 mm, and still more specifically approximately 0.05 mm.

The anchor 200 extends from a first end 205 to a second end 206 along an anchor axis B-B. The anchor 200 is elongated along the anchor axis B-B. The anchor 200 may have a length L2 of between 1.8 and 2.2 mm, and more specifically approximately 2.0 mm. In other embodiments, the anchor 200 may have a length L2 of between 1.5 and 1.6 mm, with the length L2 being dictated in part by the diameter of the tuft hole within which it is to be used. The anchor 200 may have a width W1 of between 0.25 and 0.35 mm, and more specifically approximately 0.3 mm.

Figure 7:
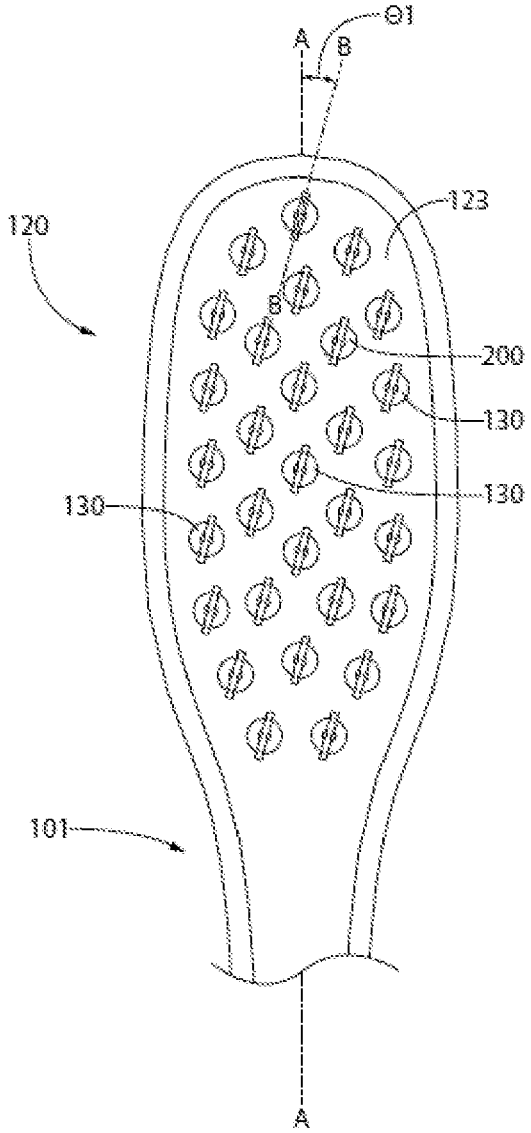
FIG. 7 is a front view of the head portion of FIG. 4 illustrating the anchors of FIG. 5 positioned within the tuft holes.

Referring to FIG. 7, the head portion 120 of the oral care implement 100 is illustrated with the bristle tufts omitted. Furthermore, in FIG. 7 one of the anchors 200 is illustrated positioned within each of the tuft holes 130. In the exemplified embodiment, each of the anchors 200 is positioned within one of the tuft holes 130 in the same orientation. Thus, the anchor axes B-B of each of the plurality of anchors 200 are parallel to one another when the anchors 200 are disposed within the tuft holes 130. Moreover, each of the anchors 200 is positioned within one of the tuft holes 130 so that its anchor axis B-B is oblique to the longitudinal axis A-A of the head portion 120. More specifically, the anchor axes B-B of the anchors 200 form a minimum intersection angle θ1 with the longitudinal axis A-A of the head portion 120 of at least 10 degrees. In other embodiments, the minimum intersection angle θ1 is at least 15 degrees. In some embodiments, the minimum intersection angle θ1 is between 10 degrees and 20 degrees, and more specifically between 12 degrees and 18 degrees, and more specifically between 14 degrees and 16 degrees, and still more specifically approximately 15 degrees. In some embodiments, the anchor axis B-B may extend at an oblique axis to the grain direction.

The minimum intersection angle θ1 between the anchor axes B-B and the longitudinal axis A-A of the head portion 120 is also the angle at which the anchor axes B-B intersects the longitudinal grain direction of the wood material of the body 101. Specifically, because the cellulosic or wood or bamboo material of the body 101 (and head portion 120 thereof) has a longitudinal grain direction, the anchor axes B-B intersects the longitudinal grain direction at an angle that is approximately equal to θ1. This further enhances the ability of the anchor 200 to retain the bristles of the bristle tufts 151 in the tuft holes 130 on the head portion 120 of the oral care implement 100.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

The invention claimed is:

1. An oral care implement comprising:

a head portion extending along a longitudinal axis from a proximal end to a distal edge, the head portion formed of a cellulosic material having a longitudinal grain direction;

the head portion comprising a plurality of tuft holes; and a plurality of bristle tufts anchored to the head portion within the plurality of tuft holes by a plurality of anchors, each of the plurality of anchors comprises an anchor body having a first surface having first anchor grooves and a second surface opposite the first surface having second anchor grooves, wherein the first anchor grooves and the second anchor grooves each have a first length, the first surface and the second surface have a second length and, the second length being at least three times the first length, each of the anchors extending along an anchor axis that is oblique to the longitudinal axis.

2. The oral care implement according to claim 1 wherein the anchor axes of the plurality of anchors are parallel to one another.

3. The oral care implement according to claim 1 wherein the anchor axes form a minimum intersection angle of at least 10 degrees with the longitudinal axis.

4. The oral care implement according to claim 1 further comprising:

the head portion comprises a first side edge and a second side edge opposite the first side edge;

the plurality of tuft holes comprising a first longitudinal row of outermost tuft holes adjacent the first side edge, the plurality of bristle tufts comprising a first longitudinal row of outermost bristle tufts disposed within and extending from the first longitudinal row of outermost tuft holes;

the plurality of tuft holes comprising a second longitudinal row of outermost tuft holes adjacent the second side edge, the plurality of bristle tufts comprising a second longitudinal row of outermost bristle tufts disposed within and extending from the second longitudinal row of outermost tuft holes;

wherein a distance between the first side edge and any one of the outermost tuft holes of the first longitudinal row of outermost tuft holes is greater than 1.80 mm; and wherein a distance between the second side edge and any one of the outermost tuft holes of the second longitudinal row of outermost tuft holes is greater than 1.80 mm.

5. The oral care implement according to claim 4 wherein the distance between the first side edge and any one of the outermost tuft holes of the first longitudinal row of outermost tuft holes is greater than 1.90 mm; and wherein the distance between the second side edge and any one of the outermost tuft holes of the second longitudinal row of outermost tuft holes is greater than 1.90 mm.

6. The oral care implement according to claim 5 wherein the distance between the first side edge and any one of the outermost tuft holes of the first longitudinal row of outermost tuft holes is at least 1.95 mm; and wherein the distance between the second side edge and any one of the outermost tuft holes of the second longitudinal row of outermost tuft holes is at least 1.95 mm.

7. The oral care implement according to claim 1 further comprising:

the plurality of tuft holes comprising a central longitudinal row of tuft holes located along the longitudinal axis, the plurality of bristle tufts comprising a longitudinal row of central bristle tufts disposed within and extending from the central longitudinal row of tuft holes; and wherein a distance between any two adjacent ones of the tuft holes of the central longitudinal row is greater than 1.50 mm.

8. The oral care implement according to claim 7 wherein the distance between any two adjacent ones of the tuft holes of the central longitudinal row is greater than 1.75 mm.

9. The oral care implement according to claim 1 wherein a ratio of the first length to the second length is 3:11.

10. An oral care implement comprising:

a head portion extending along a longitudinal axis from a proximal end to a distal edge, the head portion formed of a cellulosic material;

the head portion comprising a plurality of tuft holes;

a plurality of bristle tufts anchored to the head portion within the plurality of tuft holes by a plurality of anchors, each of the plurality of anchors comprises an anchor body having a first surface having first anchor grooves and a second surface opposite the first surface having second anchor grooves, wherein the first anchor grooves and the second anchor grooves each have a first length, the first surface and the second surface have a second length and, the second length being at least three times the first length;

the plurality of tuft holes comprising a plurality of perimeter tuft holes arranged in a loop that is adjacent a perimeter of the head portion, the plurality of bristle tufts comprising a plurality of perimeter bristle tufts disposed within and extending from the perimeter tuft holes; and wherein a distance between the perimeter and any one of the perimeter tuft holes is greater than 1.80 mm.

11. The oral care implement according to claim 10 wherein the distance between the perimeter and any one of the perimeter tuft holes is greater than 1.90 mm.

12. The oral care implement according to claim 10 wherein each of the anchors extends along an anchor axis that is oblique to the longitudinal axis.

13. The oral care implement according to claim 12 wherein the anchor axis of the plurality of anchors are parallel to one another, and wherein the anchor axes form an intersection angle of between 10 degrees and 20 degrees with the longitudinal axis.

14. The oral care implement according to claim 10 wherein the plurality of perimeter tuft holes comprises a distal-most tuft hole located adjacent the distal edge of the head, and wherein the distal-most tuft hole is located closer to the perimeter of the head portion than any of the other perimeter tuft holes.

15. The oral care implement according to claim 10 wherein the plurality of tuft holes define a tuft hole field, and wherein a spacing between the plurality of tuft holes, which is measured as a minimum linear distance from one of the plurality of tufts holes to an adjacent one of the plurality of tuft holes, varies throughout the tuft hole field.

16. The oral care implement according to claim 15 wherein the plurality of tuft holes are arranged in a plurality of longitudinal rows that are staggered relative to one another so that no tuft hole in any of the plurality of longitudinal rows is aligned with a tuft hole in an adjacent one of the plurality of longitudinal rows.

17. The oral care implement according to claim 10 wherein the cellulosic material comprises bamboo.

18. An oral care implement comprising:

a head portion formed of bamboo and extending along a longitudinal axis, the head portion comprising a plurality of tuft holes;

a plurality of bristle tufts anchored to the head portion within the plurality of tuft holes by a plurality of anchors, each of the plurality of anchors comprises an anchor body having a first surface having first anchor grooves and a second surface opposite the first surface having second anchor grooves, wherein the first anchor grooves and the second anchor grooves each have a first length, the first surface and the second surface have a second length and, the second length being at least three times the first length; and wherein the plurality of tuft holes are arranged in a plurality of longitudinal rows that are staggered relative to one another so that no tuft hole in any of the plurality of longitudinal rows is aligned with a tuft hole in an adjacent one of the plurality of longitudinal rows in a direction transverse to the longitudinal axis.

19. The oral care implement according to claim 18 wherein no plane that is transverse to the longitudinal axis intersects a centerpoint of any two tuft holes in two adjacent longitudinal rows of the plurality of longitudinal rows.

20. The oral care implement according to claim 18 wherein the plurality of tuft holes are symmetric about the longitudinal axis of the head portion.

* * * * *